United States Patent [19]

Oechslin et al.

[11] Patent Number: 4,711,583

[45] Date of Patent: Dec. 8, 1987

[54] ASTRONOMICAL WRIST-WATCH

[75] Inventors: Ludwig Oechslin, Lucerne; Urs Giger, Solothurn; Jörg Spöring, Lucerne, all of Switzerland

[73] Assignee: Ulysse Nardin S.A., Le Locle, Switzerland

[21] Appl. No.: 932,546

[22] PCT Filed: Jul. 1, 1985

[86] PCT No.: PCT/CH85/00106

§ 371 Date: Nov. 5, 1986

§ 102(e) Date: Nov. 5, 1986

[87] PCT Pub. No.: WO86/05288

PCT Pub. Date: Sep. 12, 1986

[51] Int. Cl.[4] ..... G04B 19/26

[52] U.S. Cl. ..... 368/16

[58] Field of Search ..... 368/15-20, 368/223, 228

[56] References Cited

U.S. PATENT DOCUMENTS

| | | | |
|---|---|---|---|
| 246,061 | 8/1881 | Blair | 368/15 |
| 463,101 | 2/1891 | Cory | 368/15 |
| 1,153,492 | 9/1915 | Hoitinga | 368/16 |
| 2,128,970 | 9/1938 | Smyser et al. | 368/15 |
| 4,435,795 | 3/1984 | Frank | 368/16 |
| 4,548,512 | 10/1985 | Erard | 368/15 |

FOREIGN PATENT DOCUMENTS

| | | |
|---|---|---|
| 0107177 | 5/1984 | European Pat. Off. . |
| 627042 | 12/1981 | Switzerland . |

*Primary Examiner*—Vit W. Miska

*Attorney, Agent, or Firm*—Pollock, Vande Sande & Priddy

[57] ABSTRACT

A watch designed to display, by means of indicators (7 to 10) several astronomical magnitudes. The indicators are driven by means of a planetary gear train (19) which is rotatingly supported by means of a ball bearing (20) within a support ring (11) of the watch. The drive force as well as the time reference are provided by a work (C) simultaneously driving the planet-wheel carrier (21, 22) of the planetary gear train and the gear clusters mounted thereon. Each of said clusters has a reduction ratio depending on the indicator (8 to 10) it is intended to drive.

15 Claims, 10 Drawing Figures

ASTRONOMICAL WRIST-WATCH

TECHNICAL FIELD

This invention relates to an astronomical watch by means of which astronomical magnitudes may be read directly through the intermediary of indicators moving over a dial representing the planisphere. Such timepieces are called "astrolabes".

BACKGROUND OF THE INVENTION

It has long been known to display astronomical temporal magnitudes such as the phases of the moon, the evolution of the sun and of the planets in the planisphere and in relation to the ring of the Zodiac signs, the eclipses of the sun and of the moon, etc. Horological mechanisms have been designed, e.g. for use in monuments and in astrolabes of smaller size, that can be accommodated on a table.

But the designing of astrolabes of wrist-watch size has always run into considerable difficulties, since the reduced dimensions and the need for sturdiness and reliability in such timepieces is difficult to reconcile with the complexity and the degree of precision that are expected of an astrolabe operating in a satisfactory manner and displaying the astronomical magnitudes with the required accuracy.

SUMMARY OF THE INVENTION

More particularly, as regards accuracy, this could be improved, roughly, by bettering the gear-ratio between the drive mechanism that acts as temporal reference and the astronomical magnitude indicator. This, however, can only be achieved by increasing the number of gear wheels of the reducing train, something that is of course imcompatible with miniaturization to wrist-watch size. Even if a train of differential or planetary gears were used, enabling selection of substantial reduction ratios, it is not possible to achieve both the required degree of miniaturization and accuracy, particularly if it is desired to display several astronomical temporal magnitudes at the same time.

The invention seeks to provide an astronomical watch that can be worn on the wrist and which can combine small size and high accuracy, while endowed with the sturdiness and reliability that can be expected of a wrist-watch.

The invention accordingly provides such an astronomical watch which comprises a temporal reference having a mechanical output which is coupled, via an epicyclic train of gearing, to at least one astronomical magnitude indicator, the ring gear and the driving central wheel of said train of gearing being coupled to said temporal reference, characterized in that said epicyclic train of gearing includes, for each astronomical magnitude indicator, a gear means comprising multiple rotary elements and having a predetermined reduction ratio.

The insertion, between the temporal reference and the astronomical magnitude indicator(s), of gear means borne by the planet wheel carrier of the epicyclic train of gearing leads to a reduction of the volume occupied by the reduction mechanism. This in turn enables a larger number of reducing rotary components to be used and hence greater accuracy of the arrangement. The improvement made by the invention thus results, in the final analysis, in the choice of a compromise between the size of the reduction mechanism (i.e. the number of gears used) and the degree of accuracy achieved which may be considerable despite the fact that the arrangement can be housed in the casing of a wrist-watch. By way of indication, the duration of the tropical year may be displayed with an error margin of less than one second and the duration of the synodic year may be indicated to within 0.05 second as a result of the invention.

BRIEF DESCRIPTION OF THE DRAWINGS

The invention will be better understood on reading the following description with reference to the accompanying drawings in which.

DESCRIPTION OF BEST MODE AND OTHER EMBODIMENTS

Figure 1:
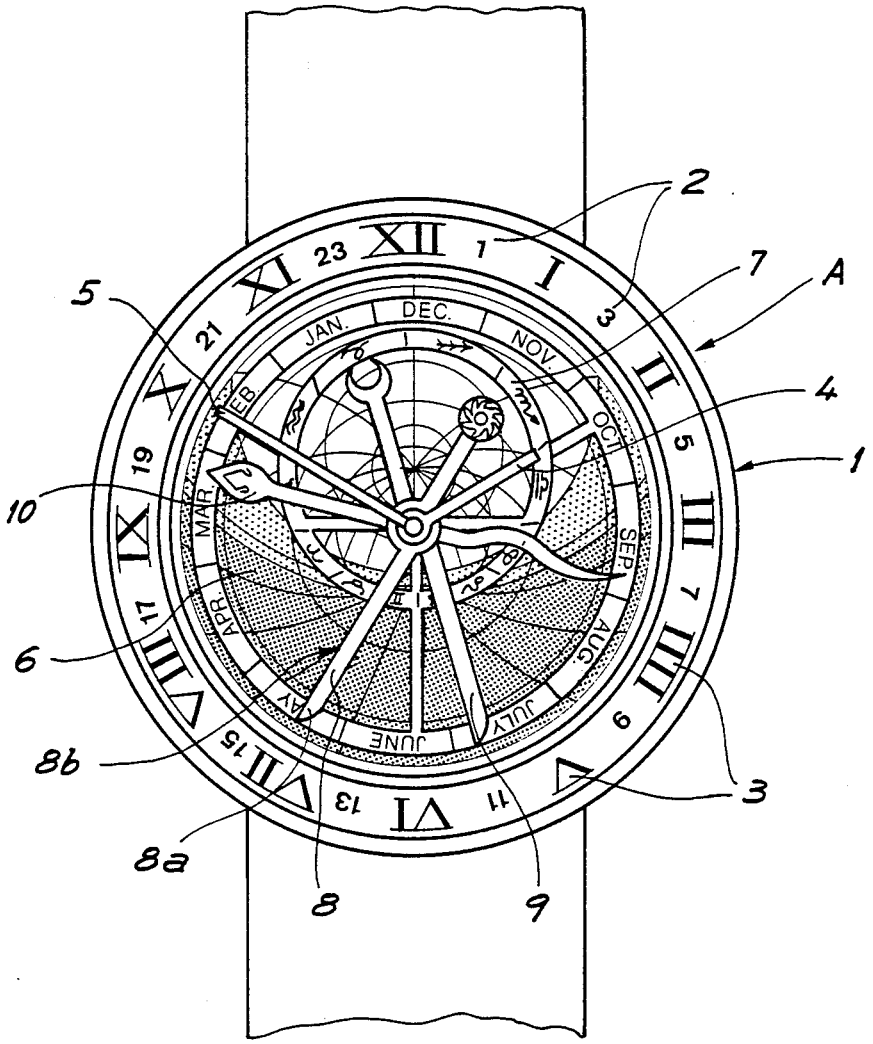
FIG. 1 shows the display arrangement of a watch according to the invention.
Figure 2:
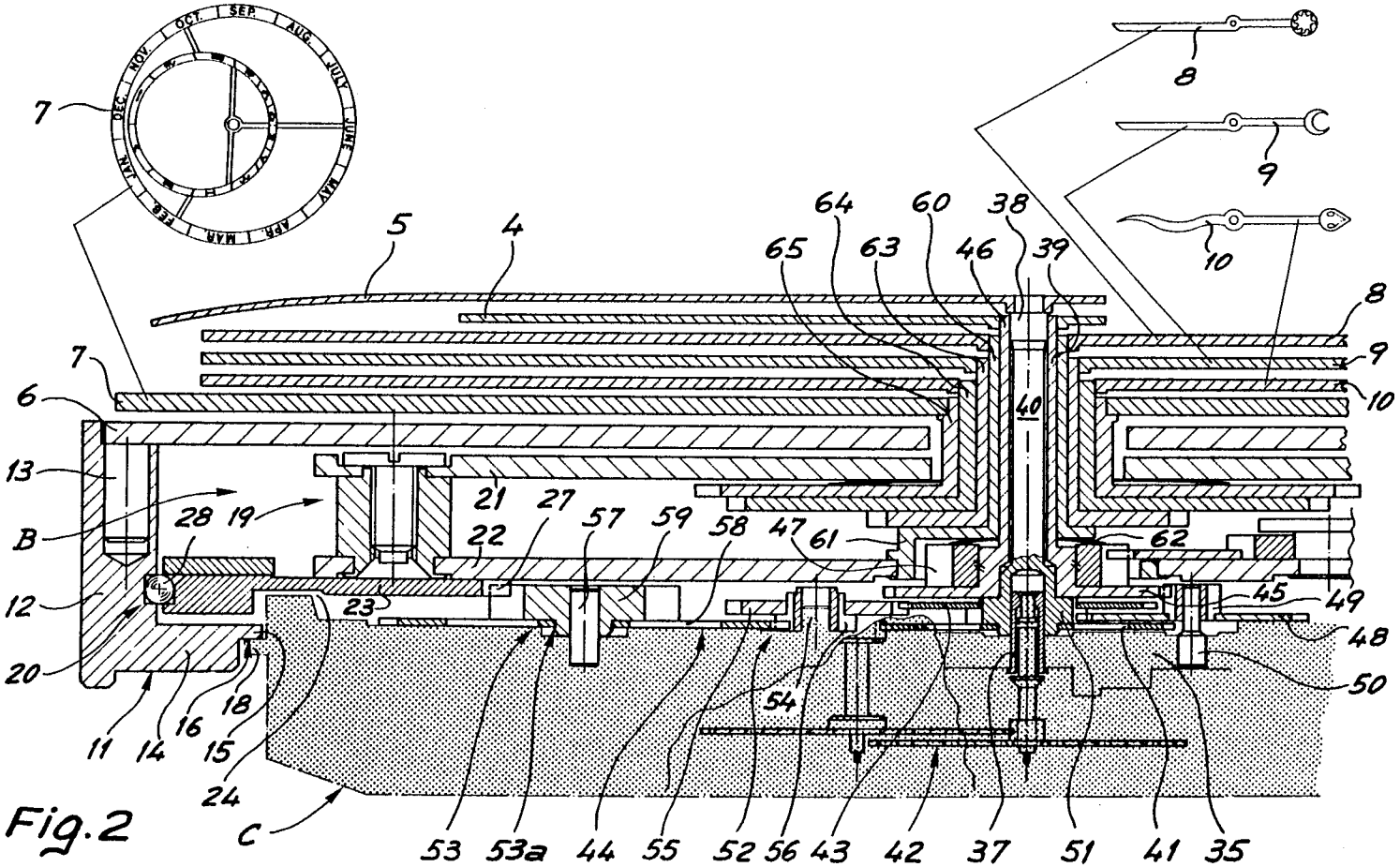
FIG. 2 is a partial cross-section of this watch, with certain parts omitted for the sake of clarity.

FIG. 1 is an outer view of the watch according to the invention and in particular shows the display arrangement A thereof. Further and as shown in FIG. 2, the watch comprises an astronomical module B, and a watch movement C which may be any kind of conventional movement of the mechanical self-winding or manual type or of the quartz electronic type. Watch movement C provides a temporal reference to the watch according to the invention.

To facilitate the following description, an inventory will first be made of the elements involved in display arrangement A with, whenever required, a summary definition of the corresponding element.

Thus, arrangement A includes:

- a case rim 1 having a graduation 2 in Arabic numerals for indicating local time and a graduation 3 in Roman numerals for indicating equinoctial time;
- an hour-hand 4 that cooperates with graduation 3, and a minute-hand 5;
- a planisphere 6 which is drawn on a dial, radially within graduations 2 and 3, and which is a flattened representation of the celestial vault as seen from a particular geographical point and from a particular geographical latitude (here 46° latitude North, i.e. Geneva);
- rete 7 which is a representation of the starry vault and which is made up of the ecliptic with the zodiacal signs and of the equator with indications for the months;

sun hand 8 which in particular indicates the local time and the month by means of its tip 8*a* and the zodiacal signs by means of its edge 8*b* in cooperation with rete 7;

moon hand 9 which, by virtue of its position in relation to that of sun hand 8, enables the moon phases and the aspects under which the sun and moon present themselves to be read;

dragon hand 10 which, by virtue of its position in relation to hands 8 and 9, enables the eclipses of the sun and moon to be read.

Astronomical module B is accommodated in an L-section supporting annulus 11 (FIG. 2) consisting of a ring 12 receiving the feet 13 of planisphere 6 and of a flange 14 which ends in an annular rib 15 defining a shoulder 16 against which bears a complementary annular rib 18 of movement C.

A frame forming the planet wheel carrier of an epicyclic train of gears 19 is rotatably mounted about the axis of module B in supporting annulus 11 via a ball bearing 20 and supports the rotary components of the astronomical module that form the planet wheels of the epicyclic train.

Figure 3A:
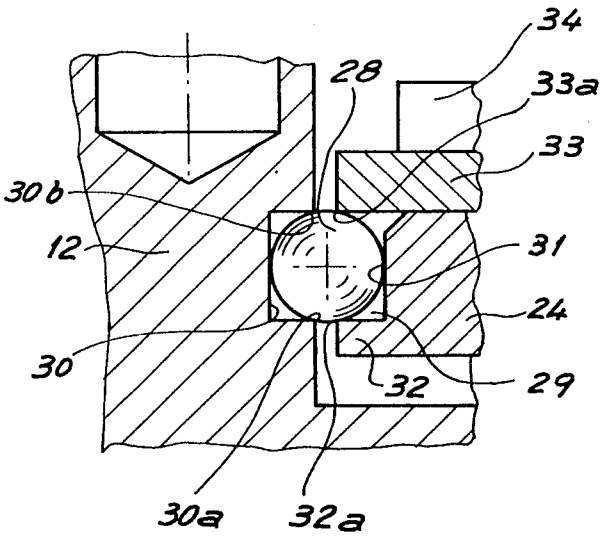
FIG. 3A illustrates on a large scale a detail of FIG. 3.
Figure 3:
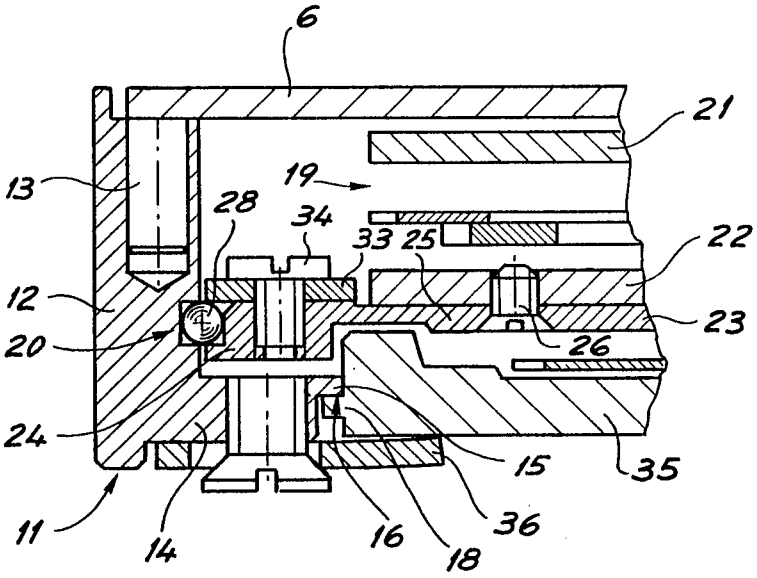
FIG. 3 shows on an enlarged scale the anti-friction bearing that acts as a suspension for the epicyclic train in its supporting annulus.
Figure 4:
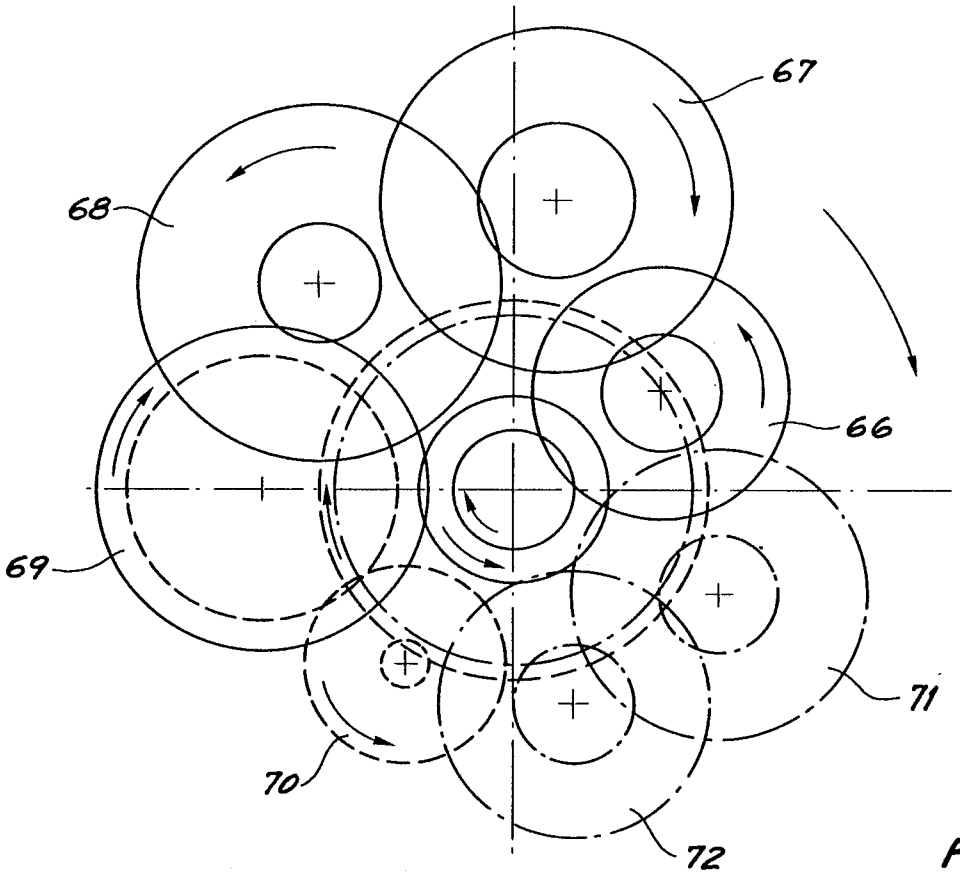
FIG. 4 is a diagrammatic plan view of the various gear means of the epicyclic train.

In FIG. 3, epicyclic train 19 is shown to include a pair of parallel, open-work plates 21 and 22 (see also FIGS. 6, 7 and 9) suitably spaced apart and fixed to each other. Plates 21 and 22 are secured to a ring 23 having a peripheral circular body 24 from which extends inwardly a rim 25 for the plates to be fixed thereto by screws 26 and for defining an inner set of teeth 27 (FIG. 2) by means of which the carrier frame of epicyclic train 19 is rotatably driven. This inner set of teeth forms the ring gear of the epicyclic train.

Bearing 20 includes a row of balls 28 that are retained in an annular chamber 29 bounded (FIG. 3A).

adjacent ring 12, by a groove 30 of rectangular cross-section, whose bottom and edges 30*a* and 30*b* are in contact with balls 28;

adjacent annular body 24, by a peripheral notch that defines an outer cylindrical surface 31 and a rim 32, the sharp edge 32*a* of the latter and cylindrical surface 31 being in contact with the balls.

Annular chamber 29 is closed off by a washer 33 screwed by screws 34 (FIG. 3) into annular body 24. The outer lower edge 33*a* of washer 33 is also in contact with balls 28.

As is clearly shown in FIG. 3A, annular chamber 29 is of a square overall cross-section that can be produced by convenient machining operations with a readily obtainable accuracy unlike that of bearings that are usually resorted to in horology, i.e. in automatic mechanical watches, wherein the ball races are V-shaped or of arcuate cross-section.

Balls 28 are maintained radially by the annular vertical walls of chamber 29 while the four annular sharp edges 30*a*, 30*b*, 32*a* and 33*a* provide axial guidance.

It will also be noted that with bearing 20 being located at the periphery of module B, a large number of free balls (i.e. balls that are not mounted in a cage) may be used. The carrying surface of the bearing is therefore very large thereby increasing the stability of the bearing. Further, the high number of points of contact enables the use of relatively soft metals for the races.

FIG. 3 additionally shows that movement C has a bottom plate 35 which is pressed against shoulder 16 by small pressure plates 36 fixed to flange 14.

As will be observed from FIG. 2, bottom plate 35 carries at its center a fixed hollow arbor 37 on which are pivotally mounted a rotary component 38 for the minutes that rotates once every hour and a rotary component 39 for the hours that rotates once every twelve hours. More particularly, rotary component 38 for the minutes includes a cannon-wheel 40 mounted on fixed arbor 37, a minute-wheel 41 meshing with the going train 42 of movement C and mounted with an exact (or frictional) fit on cannon-wheel 40, and a drive wheel 43 of a gear means 44 in the carrier frame of the epicyclic train 19.

Rotary component 39 for the hours includes an hour-wheel 45, a pipe 46 and an hour-pinion 47. Rotary component 38 for the minutes is kinematically connected to rotary component 39 for the hours by a rotary motion-work component that includes a motion-work wheel 48, and a motion-work pinion 49 pivotally mounted on a stud 50 solid with bottom-plate 35. Wheel 48 meshes with a pinion 51 provided on cannon-wheel 40 while pinion 49 meshes with hour-wheel 45. The minute and motion-work pinions and the motion-work and hour wheels are so calculated that the reduction ratio between the rotary component for the minutes and the rotary component for the hours is 1:12. Cannon-wheel 40 and pipe 46 respectively carry, at their free end, minute-hand 5 and hour-hand 4.

The carrier frame of epicyclic train 19 is rotatably driven by gear means 44 which includes a pair of rotary components 52 and 53 (FIG. 2). The first of these rotary components, which is mounted on a stud 54 solid with bottom-plate 35, includes a wheel 55 which meshes with drive wheel 43 and a pinion 56. The second rotary component of these carrier frame gear means pivots on a stud 57 solid with bottom-plate 35. It includes a wheel 58 which meshes with pinion 56 and a pinion 59 which meshes with the inner set of teeth 27 of ring 23. Drive wheel 43, the pinions and the wheels of the rotary components of carrier frame gear means 44 and the inner set of teeth 27 of ring 23 are so calculated that their gearing ratio is 1:24. In this way, the rotary component for the minutes will rotate 24 times while the carrier frame of epicyclic gear 19 rotates only once.

Because of the relatively substantial mass of cage 21, 22 which is fitted with gear means involving a plurality of rotary components, which will be described, a friction coupling 53*a* is included in the drive gear means made up of rotary components 52 and 53, such coupling being provided between wheel 58 and pinion 59.

In so doing, when the watch is subjected to a shock tending to cause carrier frame 21, 22 to rotate about its axis, the amount of motion due to the inertia of the carrier frame is not transmitted to movement C. The time shown thus remains unaffected. Indeed, pinion 59 then rotates to some extent in relation to wheel 58 which remains stationary. The mechanism is therefore effectively protected against damage from shocks.

To reduce still further the inertia of the carrier frame of the epicyclic train of gears 19, it is also better for plates 21 and 22 and for the wheels they bear to be open-work and to make its components out of light metal or alloy such as an aluminium or titanium alloy.

Figure 10:
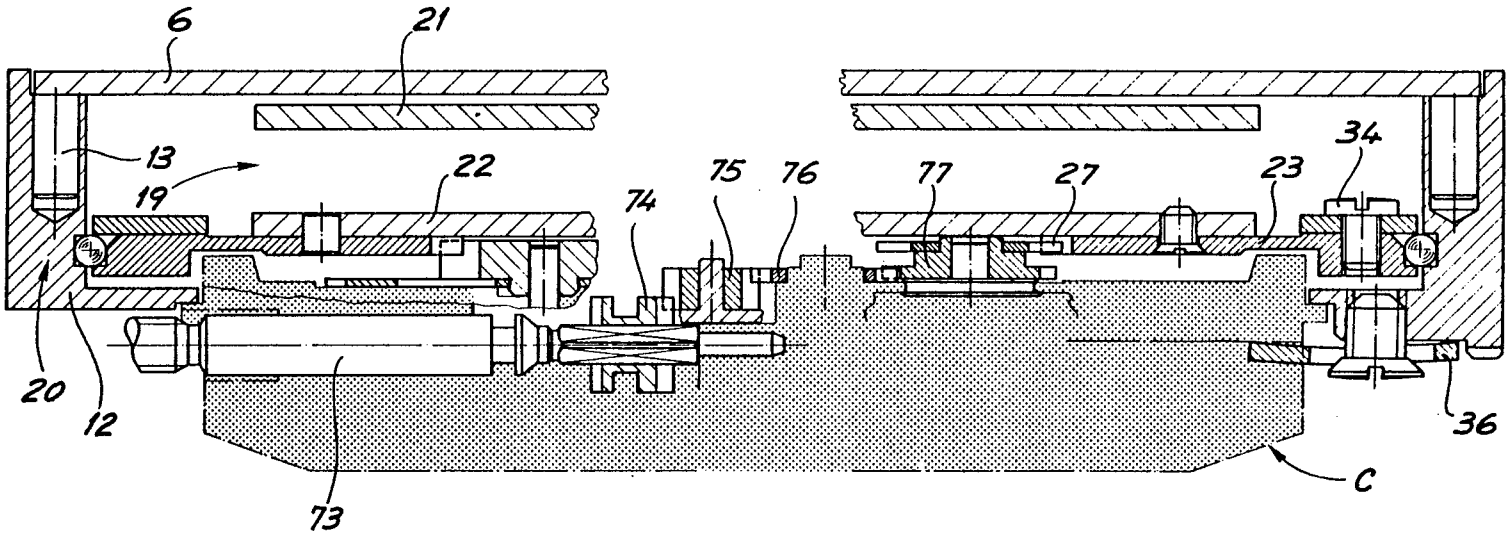
FIG. 10 is a simplified sectional view of the watch according to the invention serving to illustrate the device for adjusting the astronomical module.

The presence of the frictional coupling in rotary component 53 also enables astronomical module B to be adjusted independently of movement C (see also FIG. 10).

Planet wheel carrier frame 21, 22 (FIG. 2) carries, in its central portion, a pipe 60 which is mounted on lower plate 22 and which is coaxial with the rotary components for the hours and minutes. This pipe therefore rotates once every 24 hours. It carries sun hand 8. Pipe 60 has a flange 61 on which bears a spring 62 that also bears on hour-pinion 47. Pipe 60 additionally carries a moon wheel 63, a dragon wheel 64 and a rete wheel 65 that are coaxially mounted around one another. Each of these three wheels includes, firstly, a pipe on to which is respectively fixed the moon hand, the dragon hand and the rete, and secondly a disc having a toothed periphery adapted to be driven by a gear-train.

Reference will now be made to FIGS. 4 to 9 for an examination of these gear-trains.

These gear-trains, it will be noted, are so mounted on planetary wheel carrier frame 21, 22 that they all will perform an epicyclic movement in relation to the main axis of the watch. Additionally, rotary components 60, 63, 64 and 65 form coaxial planetary wheels in the astronomical module's epicyclic train.

Figure 5:
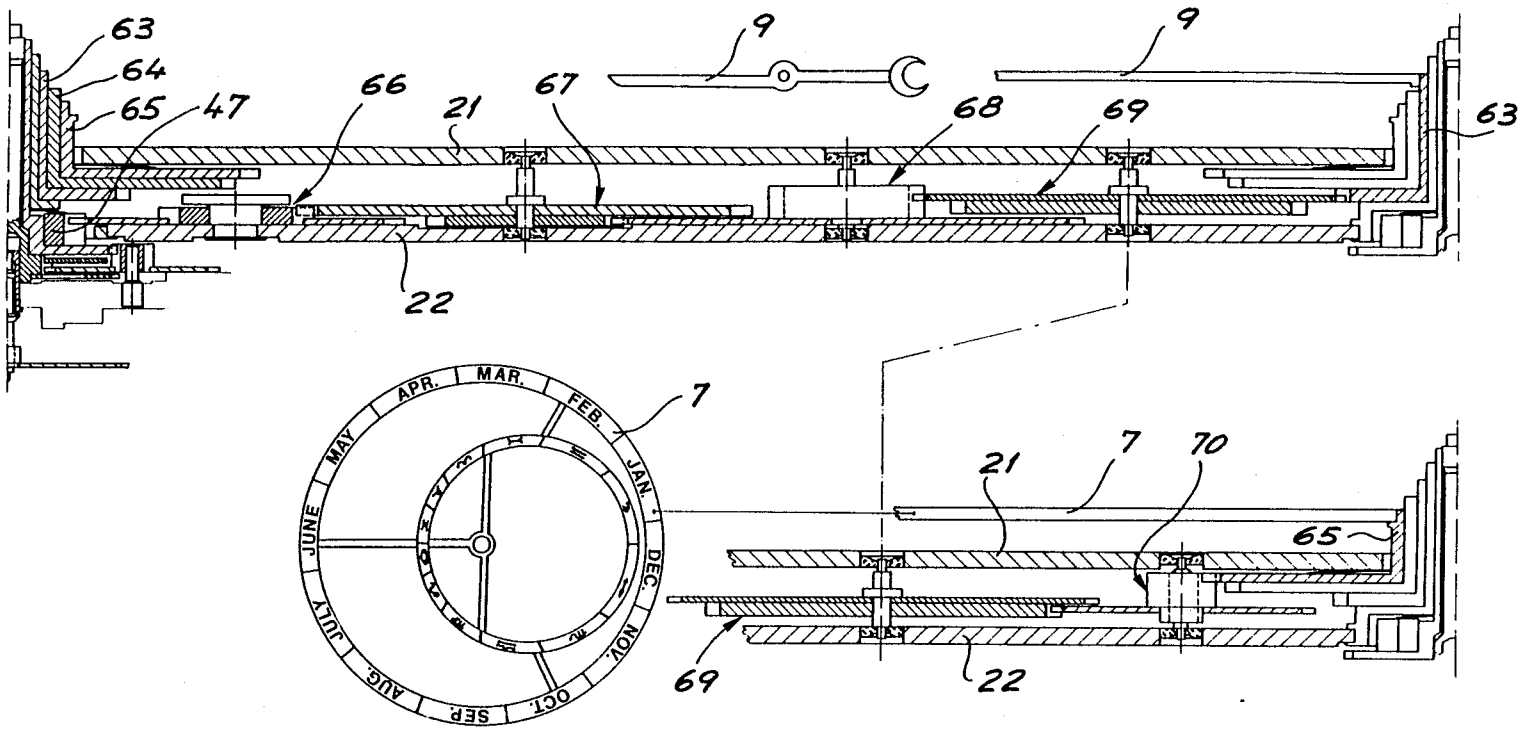
FIG. 5 is a diagrammatic sectional view showing the gear means driving the moon hand and the gear means driving the rete.
Figure 7:
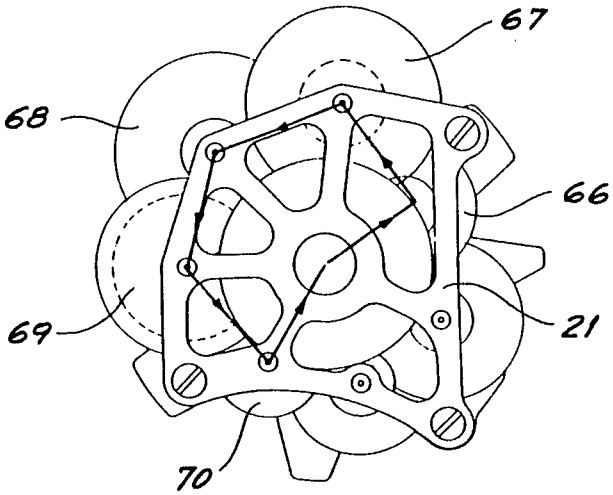
FIG. 7 is similar to FIG. 6 and shows the drive for the rete.
Figure 8:
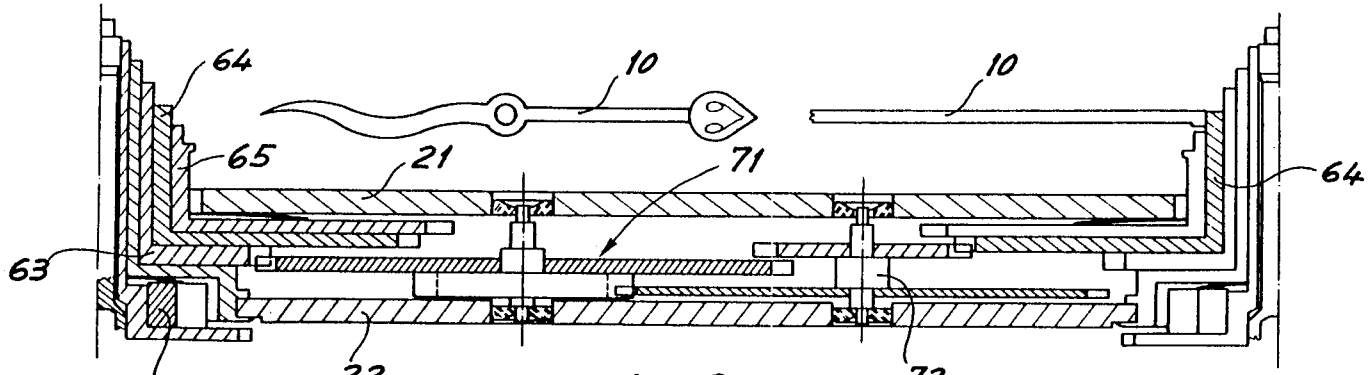
FIG. 8 is a diagrammatic sectional view on a lesser scale than FIG. 5 of the gear means driving the dragon hand.

FIGS. 4, 6, 7 and 9 also show that two of the three gear trains used here have a common portion, i.e. that serving to drive moon hand 9 and that enabling rete 7 to rotate. It will also be noted that, for purposes of illustration, the cross-sections of FIGS. 5 and 8 are taken along the rotational axes of the rotary components making up the gear trains, whereby these Figures show the central axis of the timepiece both to the right and left hand sides of the representation.

In what follows, the rotary component under consideration of the gear trains will be designated by a reference numeral without any letter indicium, while the wheels and pinions of each rotary component respectively carry the same reference numeral followed by indicium a or b.

Figure 6:
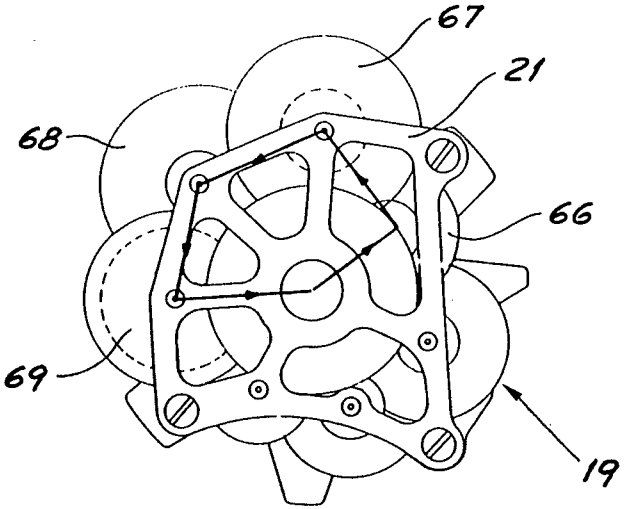
FIG. 6 is a plan view showing on a small scale the drive for the moon hand.

The gear means for the moon hand thus include a rotary component 66 whose wheel **66*a* meshes with hour-pinion 47, and then three more rotary components 67, 68 and 69, the wheel of the last rotary component driving moon wheel 63 (the pinion of rotary component 69*b* is not used for transmitting motion to the moon wheel). (FIGS. 5 and 6**).

Rete 7 is rotatably driven through the intermediary of rotary components 66, 67 and 68, with rotary component 69 participating here in full in the transmission via pinion **69*b* which meshes with a rotary component 70 whose pinion 70*b* meshes with rete wheel 65. (FIGS. 5 and 7**).

Figure 9:
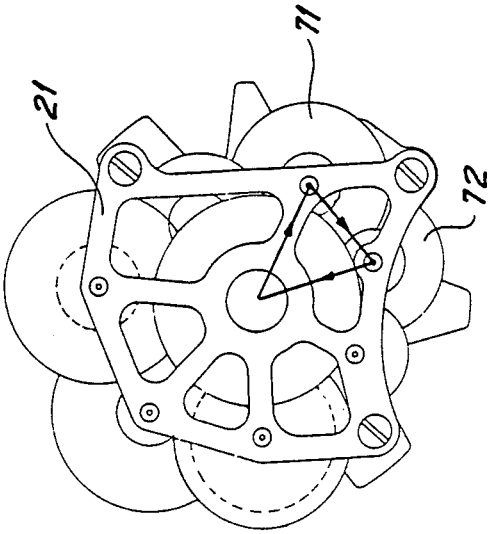
FIG. 9 is a plan view similar to FIGS. 6 and 7 showing the drive for the dragon hand.

Dragon hand 10 is driven by gear means whose input is moon wheel 63 and which include rotary components 71 and 72. (FIGS. 8 and 9).

The following table enumerates for each element of the several gear means that have just been described the number of teeth that can be used in practice, the example not being, of course, limitative.

TABLE

| | | |
|---|---|---|
| Moon hand 9 | Hour pinion 47 | 16 teeth |
| | Wheel 66a | 37 teeth |
| | Pinion 66b | 16 teeth |
| | Wheel 67a | 51 teeth |
| | Pinion 67b | 29 teeth |
| | Wheel 68a | 71 teeth |
| | Pinion 68b | 22 teeth |
| | Wheel 69a | 65 teeth |
| | Moonwheel 63 | 36 teeth |
| Rete 7 | From hour wheel 47 to wheel 69a, as before | |
| | Pinion 69b | 61 teeth |
| | Wheel 70a | 45 teeth |
| | Pinion 70b | 7 teeth |
| | Rete wheel 65 | 65 teeth |
| Dragon hand 10 | Moon wheel 63 | 36 teeth |
| | Wheel 71a | 57 teeth |
| | Pinion 71b | 22 teeth |
| | Wheel 72a | 52 teeth |
| | Pinion 72b | 22 teeth |
| | Dragon wheel 64 | 69 teeth |

Thus, according to the preferred form of embodiment of the invention, the gear-ratios are respectively:

for the moon hand:

$$\frac{16 \times 16 \times 29 \times 22}{37 \times 51 \times 71 \times 36}$$

for the rate:

$$\frac{16 \times 16 \times 29 \times 22 \times 61 \times 7}{37 \times 51 \times 71 \times 65 \times 45 \times 65}$$

for the dragon hand(starting with the moon hand):

$$\frac{36 \times 22 \times 22}{57 \times 52 \times 69}$$

FIG. 10 illustrates a device for adjusting astronomical module B. Time-setting stem 73 of movement C has a clutch-pinion 74 which, in one of its positions, meshes with a rotary component 75 of an adjustment gear means that further comprise a wheel 76 and a rotary component 77, the latter meshing with the set of teeth 27 of ring 23. This adjustment device thus enables the various indicators of the astronomical module to be corrected by direct drive from planetary wheel carrier 21, 22.

We claim:

1. An astronomical watch comprising an epicyclic train of gearing and a temporal reference means having a mechanical output which is coupled, via said epicyclic train of gearing, to at least one astronomical magnitude indicator, said epicyclic train of gearing including gear means for each astronomical magnitude indicator, a ring gear, a driving central wheel, and a rotatable planetary wheel carrier, the ring gear and the driving central wheel of said train of gearing being coupled to said temporal reference while said planetary wheel carrier is connected to a local time indicator, and said gear means comprising multiple rotary components that are mounted on the planetary wheel carrier of the train and that have a predetermined reduction ratio.

2. An astronomical watch as in claim 1 wherein said planetary wheel carrier includes a pair of parallel, spaced plates rotatably mounted about the axis of the watch in a supporting annulus via an anti-friction bearing coaxial with said axis.

3. An astronomical watch as in claim 2 wherein said anti-friction bearing includes opposing races bounding an annular chamber of roughly square cross-section, and a plurality of balls disposed in said annular chamber.

4. An astronomical watch as in claim 3 wherein said chamber is bounded by a pair of oppositely facing grooves of rectangular cross-section, with one being provided in the supporting annulus and the other by the planetary wheel carrier, the balls being in contact with the bottoms of these grooves to provide radial guidance for the bearing and with the edges of these grooves for axial guidance purposes.

5. An astronomical watch as in claim 4 wherein the groove provided by the planetary wheel carrier is bounded by a ring secured to the plates of the planetary wheel carrier and projecting outwardly beyond their periphery, and by a closure washer secured to said ring.

6. An astronomical watch as in claim 1 wherein the planet wheel carrier of the epicyclic train is coupled to said temporal reference through the intermediary of a transmission that includes at least one friction coupling.

7. An astronomical watch as in claim 6 wherein said ring secured to the planetary wheel carrier has an inner set of teeth which comprises the ring gear of said epicyclic train and which meshes with an output wheel of said temporal reference through the intermediary of said transmission.

8. An astronomical watch as in claim 2 wherein each gear means further comprises an output member including a pipe that is coaxial with the axis of the watch and a disc that is at right angles to said axis and which lies in the space between said plates, said pipe being solid with the corresponding indicator.

9. An astronomical watch as in claim 1 wherein said local time indicator is mounted on a pipe that is coaxial with the axis of the watch and is fixed by a radial flange to the planetary wheel carrier.

10. An astronomical watch as in claim 8 comprising a plurality of astronomical magnitude indicators and wherein the disc of each output member is borne by the planetary wheel carrier and lies immediately adjacent to the disc of another output member, and the pipes of these output members are coaxially inserted into one another.

11. An astronomical watch as in claim 1 wherein one of the astronomical indicators is a moon hand, the gear means of said moon hand having multiple rotary components that couple an hour member to said moon hand by a gear ratio of:

$$\frac{16 \times 16 \times 29 \times 22}{37 \times 51 \times 71 \times 36}$$

12. An astronomical watch as in claim 1 wherein one of the astronomical indicators is a rete representing the starry vault and the months of the year, the gear means of said rete having multiple rotary components that couple an hour member to said rete indicator by a gear-ratio of:

$$\frac{16 \times 16 \times 29 \times 22 \times 61 \times 7}{37 \times 51 \times 71 \times 65 \times 45 \times 65}$$

13. An astronomical watch as in claim 1 wherein one of said astronomical indicators is a moon hand and another of said astronomical indicators is a rete representing the starry vault and the months of the year, and the gear means that drive the moon hand and the gear means that drive the rete have common rotary components.

14. An astronomical watch as in claim 11 wherein another of the astronomical indicators is a dragon hand, the gear means of said dragon hand including multiple rotary components that couple said moon hand to said dragon hand by a gear-ratio of:

$$\frac{36 \times 22 \times 22}{57 \times 52 \times 69}$$

15. An astronomical watch as in claim 14 wherein the gear means of said dragon hand includes the rotary components that are associated with the gear means of said moon hand and a further set of multiple rotary components that are mounted in series between the gear means of the moon hand and the dragon hand.

* * * * *